US009194578B2

(12) United States Patent
Bettinzoli

(10) Patent No.: US 9,194,578 B2
(45) Date of Patent: Nov. 24, 2015

(54) GAS BURNER FOR DOMESTIC COOKERS

(75) Inventor: Angelo Bettinzoli, Concesio (IT)

(73) Assignee: SABAF S.P.A, Ospitaletto (BS) (IT)

( * ) Notice: Subject to any disclaimer, the term of this patent is extended or adjusted under 35 U.S.C. 154(b) by 707 days.

(21) Appl. No.: 13/131,529

(22) PCT Filed: Dec. 12, 2008

(86) PCT No.: PCT/IT2008/000760
§ 371 (c)(1),
(2), (4) Date: May 26, 2011

(87) PCT Pub. No.: WO2010/067391
PCT Pub. Date: Jun. 17, 2010

(65) Prior Publication Data

US 2011/0232628 A1 Sep. 29, 2011

(51) Int. Cl.
*F23D 14/06* (2006.01)
*F23D 14/58* (2006.01)
*F23D 14/26* (2006.01)

(52) U.S. Cl.
CPC ..... *F23D 14/06* (2013.01); *F23D 14/58* (2013.01); *F23D 2207/00* (2013.01); *F23D 2900/14062* (2013.01)

(58) Field of Classification Search
CPC ..... Y02B 40/166; F23D 2207/00
USPC ..... 126/39 E
See application file for complete search history.

(56) References Cited

U.S. PATENT DOCUMENTS 2,640,531 A 6/1953 Lamar
2,860,696 A * 11/1958 Reinhart ..... 239/549
2,891,608 A 6/1959 Mueller
3,162,237 A * 12/1964 Brown et al. ..... 126/39 R
3,258,058 A * 6/1966 L Herault et al. ..... 431/329
3,796,535 A * 3/1974 De Gouville ..... 431/349
4,518,346 A * 5/1985 Pistien ..... 431/266
4,541,407 A * 9/1985 Sommers et al. ..... 126/39 E
4,846,671 A * 7/1989 Kwiatek ..... 431/266
5,133,658 A * 7/1992 Le Monnier De Gouville et al. ..... 431/349
5,325,842 A * 7/1994 Beach et al. ..... 126/39 R (Continued)

FOREIGN PATENT DOCUMENTS

DE 102006053426 A1 5/2008
EP 0719982 7/1996

(Continued)

*Primary Examiner* — Gregory Huson
*Assistant Examiner* — Martha Becton
(74) *Attorney, Agent, or Firm* — Lucas and Mercanti, LLP.

(57) ABSTRACT

Burner (1) for gas cookers, of the type comprising at least one flame spreader (2) and at least a corresponding lid (3) adapted to define at least partially a transit chamber (20) for a gas-primary air fuel mixture, said at least one flame spreader (2) comprising at least a plurality of radial outlets (4) to feed a plurality of main flames with said fuel mixture, and at least one outflow port (5), placed over said plurality of radial outlets (4), to feed with said fuel mixture at least one pilot flame, said at least one outflow port (5) being shaped to direct said at least one pilot flame towards said at least one plurality of radial outlets (4). The burner further comprises at least one storage chamber (6) for the fuel mixture for said at least one pilot flame, placed nearby and in fluidic connection with said at least one outflow port (5), said storage chamber (6) being fed by one or more inlets (7) disposed in fluidic communication with said transit chamber (20) for the fuel mixture.

17 Claims, 4 Drawing Sheets

(56) References Cited

U.S. PATENT DOCUMENTS

| | | | | |
|---|---|---|---|---|
| 5,765,542 | A * | 6/1998 | Fey et al. | 126/39 E |
| 5,772,421 | A * | 6/1998 | Besik et al. | 431/8 |
| 5,899,681 | A * | 5/1999 | Maughan | 431/8 |
| 6,035,846 | A * | 3/2000 | Saleri | 126/39 H |
| 6,132,205 | A | 10/2000 | Harneit | |
| 6,209,534 | B1 * | 4/2001 | Taplan | 126/39 R |
| 6,244,263 | B1 * | 6/2001 | Schlosser et al. | 126/39 R |
| 6,443,728 | B1 * | 9/2002 | Edberg et al. | 431/266 |
| 6,589,046 | B2 * | 7/2003 | Harneit | 431/266 |
| 6,607,378 | B2 * | 8/2003 | Harneit et al. | 431/354 |
| 6,764,303 | B2 * | 7/2004 | Dane et al. | 431/354 |
| 6,880,491 | B2 * | 4/2005 | Reiner et al. | 122/4 R |
| 7,040,890 | B2 * | 5/2006 | Todoli et al. | 431/266 |
| 7,731,493 | B2 * | 6/2010 | Starnini et al. | 431/354 |
| 2004/0166454 | A1 * | 8/2004 | Zwicker | 431/263 |
| 2004/0177616 | A1 * | 9/2004 | Buey et al. | 60/765 |
| 2008/0069740 | A1 * | 3/2008 | Kitayama et al. | 422/163 |
| 2008/0202494 | A1 * | 8/2008 | Paesani | 126/39 E |
| 2009/0078247 | A1 * | 3/2009 | Sun | 126/39 R |
| 2009/0087804 | A1 * | 4/2009 | Pryor et al. | 431/350 |
| 2009/0145422 | A1 * | 6/2009 | Paesani | 126/39 E |
| 2011/0120446 | A1 * | 5/2011 | Simms et al. | 126/39 E |
| 2011/0240460 | A1 * | 10/2011 | Begounov et al. | 204/164 |
| 2011/0290231 | A1 * | 12/2011 | Padgett | 126/215 |
| 2013/0065188 | A1 * | 3/2013 | Clark | 431/354 |
| 2013/0199513 | A1 * | 8/2013 | Bettinzoli | 126/39 E |

FOREIGN PATENT DOCUMENTS

| | | | |
|---|---|---|---|
| EP | 0797048 | A1 | 9/1997 |
| FR | 2620199 | | 3/1989 |
| LU | 44602 | A1 | 4/1965 |
| NL | 8501113 | | 11/1985 |

* cited by examiner

GAS BURNER FOR DOMESTIC COOKERS

CROSS-REFERENCE TO RELATED APPLICATION

This application is a 371 of PCT/IT2008/000760 filed Dec. 12, 2008, the contents of which are incorporated herein by reference.

FIELD OF THE INVENTION

The present invention refers to a burner for cookers fed by a gas-air fuel mixture.

BACKGROUND ART

Particularly, the present invention refers to a type of burner wherein the outflow port, or ports, for feeding the pilot flame with a gas-primary air mixture is disposed, or are disposed, over the radial outlets adapted to feed the main flames with such a gas-primary air mixture. Such an outflow port is particularly shaped to direct the pilot flame towards the outlets of the main flames, so as to allow the ignition of the latter. Such a burner, responding to a particular normative prescription of some countries, further provides that the outflow port for the pilot flame and the radial outlets for the main flames are realized, at least partially, in the so-called flame spreader, that is, in its turn, closed by a top lid.

It has to be observed that with "flame spreader" is usually meant an annular element provided with, at least partially on its perimeter wall, cuttings or holes, providing the gaseous fluid outflow. Such an annular element is an outer side wall of a transit chamber of the gas-primary air fuel mixture in a burner, so as to define a flame crown of the burner itself. The flame spreader, according to a known art, may be realized as a different piece, or otherwise may be obtained in one piece with the burner body.

Domestic burners having the outflow port, or ports, for feeding the pilot flame, placed over the radial outlets for feeding the main flames, are known.

For example, the European Patent Application EP-A-0945679, in the name of GAZ DE FRANCE, teaches to realize an outflow port for a pilot flame, placed over the main flames, obtained between the upper surface of a flame spreader and the lower surface of the corresponding lid.

More particularly, the GAZ DE FRANCE Patent Application teaches to obtain some prominences (i.e. studs), reciprocally spaced, between the upper lid and the corresponding flame spreader, which are placed over a plurality of outlets of the gas-primary air mixture for the main flames, and extend only partially for the whole thickness of the flame spreader, such that, upstream of such a prominences, an annular slit (opening) between the flame spreader itself and the corresponding lid is obtained. Such prominences allow the passing of a predetermined amount of the gas-primary air fuel mixture into such an annular slit (opening), which generates, once ignited, a laminar pilot flame being able to cause the ignition of the main flames below.

Such a burner has however some drawbacks. Indeed, because the outflow port for the pilot flame is placed over the plurality of the outlets for the main flames, the gas-primary air mixture outflow through the exit opening for feeding the pilot flame may be particularly irregular and unstable, above all during the ignition step of the pilot flame itself, or in the ignition transitory of the main flames. The Applicant has experimentally verified that, straight after the combustion spark by the ignition spark plug, a series of thermo-fluiddynamic events developing around the region of the combustion spark will not allow to obtain an appropriate gas-primary air mixture exchange through the outflow port. Substantially the pilot flame is not fed adequately during the ignition transitory, thereby resulting irregular, with the drawback that the primary flame ignition is compromised too.

In addition, in the case of a burner provided with more flame concentric crowns, that is provided with two or more flame spreaders, the combustion instability found in single flame crowns leads to a non-contemporary, and difficult, ignition of every primary flame of such crowns of burner flames.

Object of the present invention is to realize a burner of the type afore illustrated, that allows to stabilize the pilot flame combustion at least during the ignition step thereof, and then during the ignition of the main flames, as well as to stabilize the combustion itself of the gas-primary air mixture of the main flames during the burner use.

A further object of the present invention is to realize a burner that, in case it is provided with more flame crowns, will guarantee a substantially contemporaneous ignition and a more efficient combustion of the main flames present in each flame crowns, even if igniting, by an apposite ignition spark plug, only one crown of main flames of the burner.

SUMMARY OF THE INVENTION

These and other objects are obtained by the present burner for gas cookers provided with at least one flame spreader and at least one corresponding lid adapted to partially define a transit chamber for a gas-primary air fuel mixture, said at least one flame spreader comprising at least a plurality of radial outlets to feed a plurality of main flames with a gas-primary air fuel mixture, and at least one outflow port, placed over the said plurality of radial outlets, to feed with a gas-primary air fuel mixture at least one pilot flame, and shaped to direct the said at least one pilot flame towards the said at least one plurality of radial outlets. Advantageously the afore said burner comprises at least one storage (i.e. accumulation) chamber of the gas-primary air fuel mixture for said pilot flame, placed nearby and in fluidic connection with said at least one outflow port, said storage chamber being fed by one or more inlets for said fuel mixture disposed in fluidic communication with such a transit chamber. Substantially, according to the invention, immediately upstream of the outflow port of the pilot flame, is disposed, in fluidic connection with such a port, a storage chamber, in its turn placed downstream of one or more inlet port for the fuel mixture, which chamber having the double task of generating a controlled pressure drop of the fuel mixture exiting from the inlets and further of containing a certain volume of fuel mixture accumulating during at least the ignition transitory of the pilot flame and/or the main flames. In this way, during the ignition transitory, but during the regular functioning of the burner too, differently from what happens in the burners of the known art, the storage chamber will operate as a stabilizer of the exit pressure of the fuel mixture feeding the pilot flame from the corresponding outflow port, as well as it will operate as a auxiliary reservoir of the fuel mixture, being able to guarantee the even and regular feeding of such a gas-primary air mixture to the pilot flame, aiding the stability thereof.

According to the invention, the presence of a storage chamber for the fuel mixture assures an appropriate feeding, relatively to flow rate and pressure, of such a mixture to the outflow port of the pilot flame, at least for the ignition transitory of the burner, and thereby allows to stabilize the pilot flame combustion, and therefore the main flames.

The storage chamber thus performs the function of regulating the flow pressure, and therefore the flow rate and flow speed of the exiting fuel mixture, preventing the local instantaneous changes of the outer pressure, at the outflow port of the pilot flame of the burner, from involving irregularities in the pilot flame distribution, with a consequent difficult and irregular ignition and/or operation of the burner.

According to a preferred embodiment of the invention, the afore said storage chamber and the afore said outflow port are defined by at least a portion of the inner peripheral surface of the lid and at least part of the upper peripheral surface of the flame spreader. Preferably, in addition, the lower surface of the lid is shaped to direct the pilot flame towards the afore said plurality of the radial outlets for the main flames.

Further, the said storage chamber and the afore said outflow port may have an annular shape and may extend for at least part of the perimeter portion of the flame spreader. Preferably, the storage chamber and the outflow port are annularly extended for the whole perimeter portion of the flame crown, such that the burner is provided with only one pilot flame, having a laminar shape.

According to another embodiment of the present invention, the burner comprises at least two concentric flame spreaders, one being central, the other peripheral, with the corresponding lids, defining at least two corresponding flame crowns. Advantageously, the lid of the peripheral flame spreader is provided with at least one radial notch for the passing, towards the flame crown of the central flame spreader, of a fuel mixture flow intended to be ignited thanks to the flames of the central flame spreader itself.

In addition, according to another aspect of the present invention, both the central and the peripheral flame spreaders, have not only a corresponding outflow port for the pilot flame, but likewise have their own storage chamber of the fuel mixture, interposed between such an outflow port for the pilot flame and at least one radial inlet, such that the central flame spreader ignition would cause the pilot flame ignition of the peripheral flame spreader.

It has to be outlined that, alternatively, the hole obtained on the lid of the peripheral flame spreader may be used for transporting a pilot flame from such a peripheral flame spreader to nearby the central flame spreader, such that to ignite the fuel mixture exiting from the latter.

BRIEF DESCRIPTION OF THE FIGURES

For purposes of illustrations and not limitative, more preferred embodiments of the present invention will be provided with reference to the accompanying drawings, in which.

DETAILED DESCRIPTION OF SOME PREFERRED EMBODIMENTS OF THE PRESENT INVENTION

Figure 1:
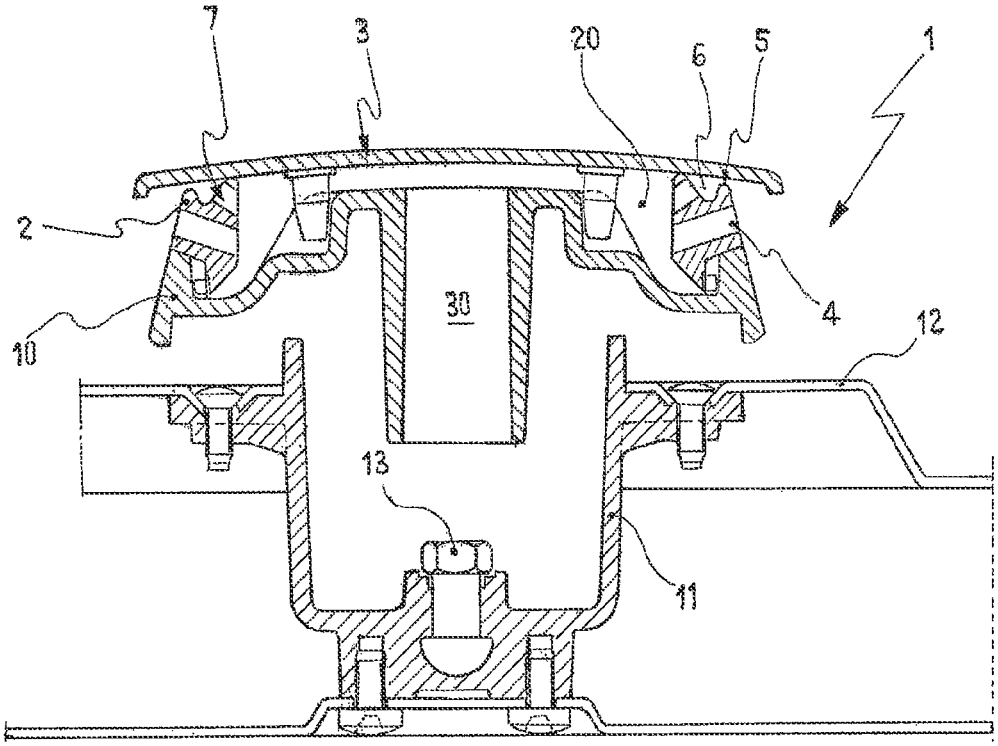
FIG. 1 is an exploded section view of a burner according to the invention.

Referring particularly to such figures, with 1 is shown a burner according to the present invention.

The burner 1 for gas cooker, according to a particular aspect of the invention, is provided with a flame spreader 2 and a corresponding lid 3, having the complementary shape of the upper surface of the flame spreader 2, the flame spreader 2 and the lid 3 defining, with a beneath body 10 of the burner 1, a transit chamber 20 for a gas-primary air fuel mixture. The flame spreader 2 comprises, in its turn, a plurality of radial outlets 4 for feeding with a gas-primary air fuel mixture a plurality of main flames, and an outlet port 5, placed over the afore said plurality of outlets 4, adapted for feeding a pilot flame with such a fuel mixture. The outlets 4 are obtained by a plurality of through holes 40 passing through the flame spreader 2.

The flame spreader 2 is engaged, according to the known art, with the body 10 of the burner 1, the body 10 comprising at least part of the Venturi effect chamber 30 for mixing the primary air with the fuel gas, and such a body 10, in its turn, is coupled to a corresponding cup 11, this latter comprising in its turn the nozzle 13 for ejecting the fuel gas, as well as means for its fixing to the supporting plane 12 of a cooking domestic equipment.

The gas-primary air fuel mixture, formed thanks to the mixing chamber with Venturi effect 30, feeds a transit chamber 20 of the fuel mixture, that—as afore said—is laterally defined by the flame spreader 2 and at top by the lid 3. The transit chamber 20, in its turn, feeds both the outlets 4 for the main flames, and the outflow port 5 for the pilot flame.

The outflow port 5, extending for the whole (circular) perimeter portion of the flame spreader 2, is so shaped as to establish a laminar pilot flame, directed towards the plurality of radial outlets 4 for the main flames. This is aided too by the shape, bent downstream ofs, that the lid 3 presents at its peripheral end 3*a*. As shown for example in FIG. 2, indeed, the lid 3 is provided with a portion of the end 3*a* turning towards the radial outlets 4 and then, conveniently shaped for directing the pilot flame towards a plurality of outlets 4.

According to the known art, the ignition of the fuel mixture exiting from such an outflow port 5, by an appropriate ignition spark plug placed at an areola of the outflow port 5 itself, starts the generation of the pilot flame, in this case laminar and extended for the whole circular perimeter of the burner 1, having the scope both to ignite the fuel mixture exiting from outlets 4, during the ignition transitory of the burner 1, and to stabilize the combustion of such a mixture exiting from such outlets 4, during the working of the burner 1 itself.

The outflow port 5, in the particular embodiment of the invention shown herein, being obtained between the end 3*a*, bent downstream ofs, of the lid 3 and the upper surface of the flame spreader 2 of the burner 1, for the whole perimeter of the latter, may be alternatively replaced by a plurality of holes or apertures obtained on the lid 3, or the flame spreader 2, or between the first and the latter, and may concern only part of the perimeter development of the flame spreader itself 2 as well.

According to the present invention, the burner 1 further comprises a storage chamber 6 of the fuel mixture for said pilot flame that is in fluidic connection with the outflow port 5 and is fed as well by a plurality of inlets 7, radially obtained in the flame spreader 2 of the burner 1.

The storage chamber 6, that in the particular embodiment herein shown is, for the main part, obtained in the upper surface of the flame spreader 2, and it is shaped in such a way to allow, for the expansion of the fluid and for the load losses that the fluid is subjected to, a pressure drop sufficient to allow the storage (accumulation) of the fuel mixture in such a chamber 6 and the delivering with a substantially constant pressure of the fuel mixture at the afore said outflow port 5 for the pilot flame.

More in detail, according to an embodiment herein illustrated, the storage chamber 6 and the port 5 are defined by a lower peripheral surface 8 part of the lid 3 and by a part of the upper peripheral surface 9 of the flame spreader 2 and are extended, annularly, for the whole circular perimeter of the latter.

It has to be noticed that, alternatively, such a storage chamber 6 may be obtained only on the lower surface of the lid 3 or between this latter and the upper surface of the flame spreader 2, without therefore falling out from the protection scope demanded.

The radial inlets 7, that may be for example in the number of 8 or 16, are disposed in such a way to be angularly equidistant the one from another. It has to be mentioned that the radial inlets 7 are obtained, in the particular burner 1 herein illustrated by the through holes 70 passing through the flame spreader 2.

According to an embodiment herein not illustrated, the inlets 7 for the storage chamber 6 may be defined too by part of the lower peripheral surface 8 of the lid 3 and part of the upper peripheral surface 9 of the flame spreader 2. In such a case, according to such an embodiment, the holes 70 previously defined may be replaced by a plurality of passages (herein not illustrated) obtained between the flame spreader 2 and the corresponding lid 3.

As afore mentioned, the storage chamber 6 and the port 5 have annular shape and are extended for the whole perimeter portion of the flame spreader 2. It has to be observed that, anyway, the port 5 may also not be extended for the whole length of the perimeter portion of the flame spreader 2, but only for the perimeter portion of the latter, without therefore falling out from the protection scope of the present invention.

It has to be noticed as well that an alternative embodiment of the burner presenting any number of inlets 7, outflow ports 5 for the same storage chamber 6, or any number of storage chambers 6, falls within the scope of protection of the present invention.

Figure 3:
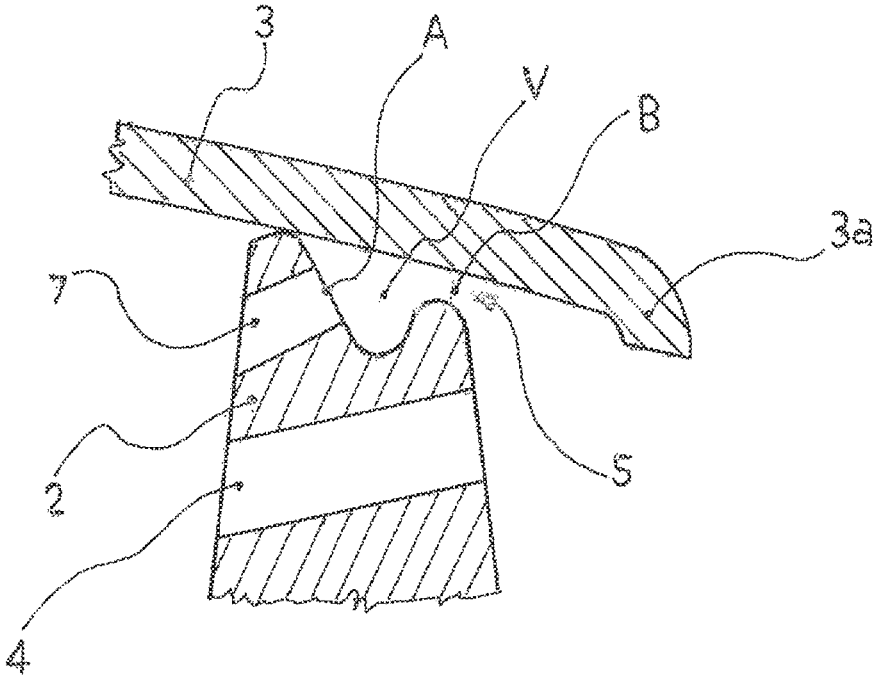
FIG. 3 is a detailed section view of the storage chamber of the burner of FIGS. 1 and 2.

Particularly referring to FIG. 3, the Applicant found in practice that keeping the area of the exit section A of the inlets 7 comprised between 20 and 50 $mm^2$, the area of the total exit section B of the outflow port 5 comprised between 65 and 250 $mm^2$ and the volume V of the storage chamber 6 comprised between 350 e 2200 $mm^3$, an effective pilot flame stabilization generated at the port exit 5 is obtained.

More in detail, the Applicant found that keeping a ratio between the area of exit sections A of the inlets 7 and the area of the total exit section B of the outflow port 5 comprised between 2.9 and 5.8 with a volume V of the chamber 6 not lower than 350 $mm^2$, and increasing with the area B of the exit section of the outflow port 5 increasing, the stabilization of the pilot flame would be optimal.

It has to be observed that the area of the total section A of the inlets 7 is determined by the sum of the areas of the single sections of each inlet 7 in fluidic connection with the storage chamber 6 itself. In the same way, in case of more outflow ports 5 for one storage chamber 6, the area of the total section B is given by the total sum of the single section areas of the outflow ports 5 being present. It has further to be observed that the section B of the outflow port 5 is calculated at the point locus wherein the lid 3 and the flame crown 2 have the lower distance, whereas the section A is calculated at the exit section of the holes 70 defining the inlets 7 for the chamber 6.

Figure 5:
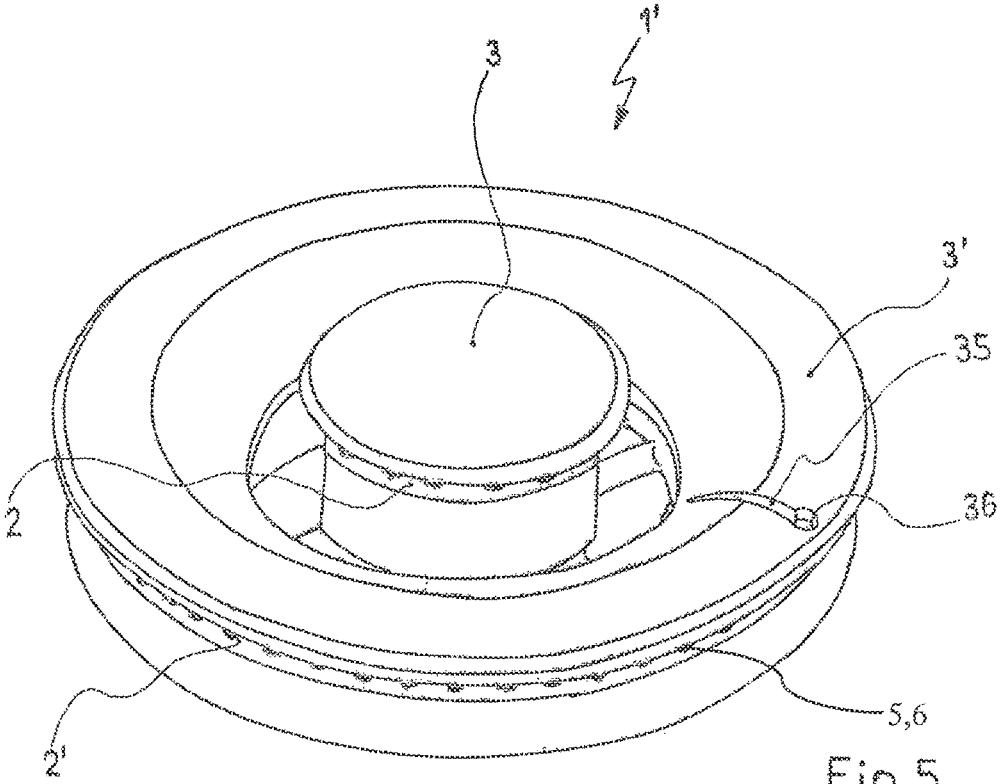
FIG. 5 is a prospective view of the burner of FIG. 4 wherein the notch realized on the peripheral lid is evident.
Figure 4:
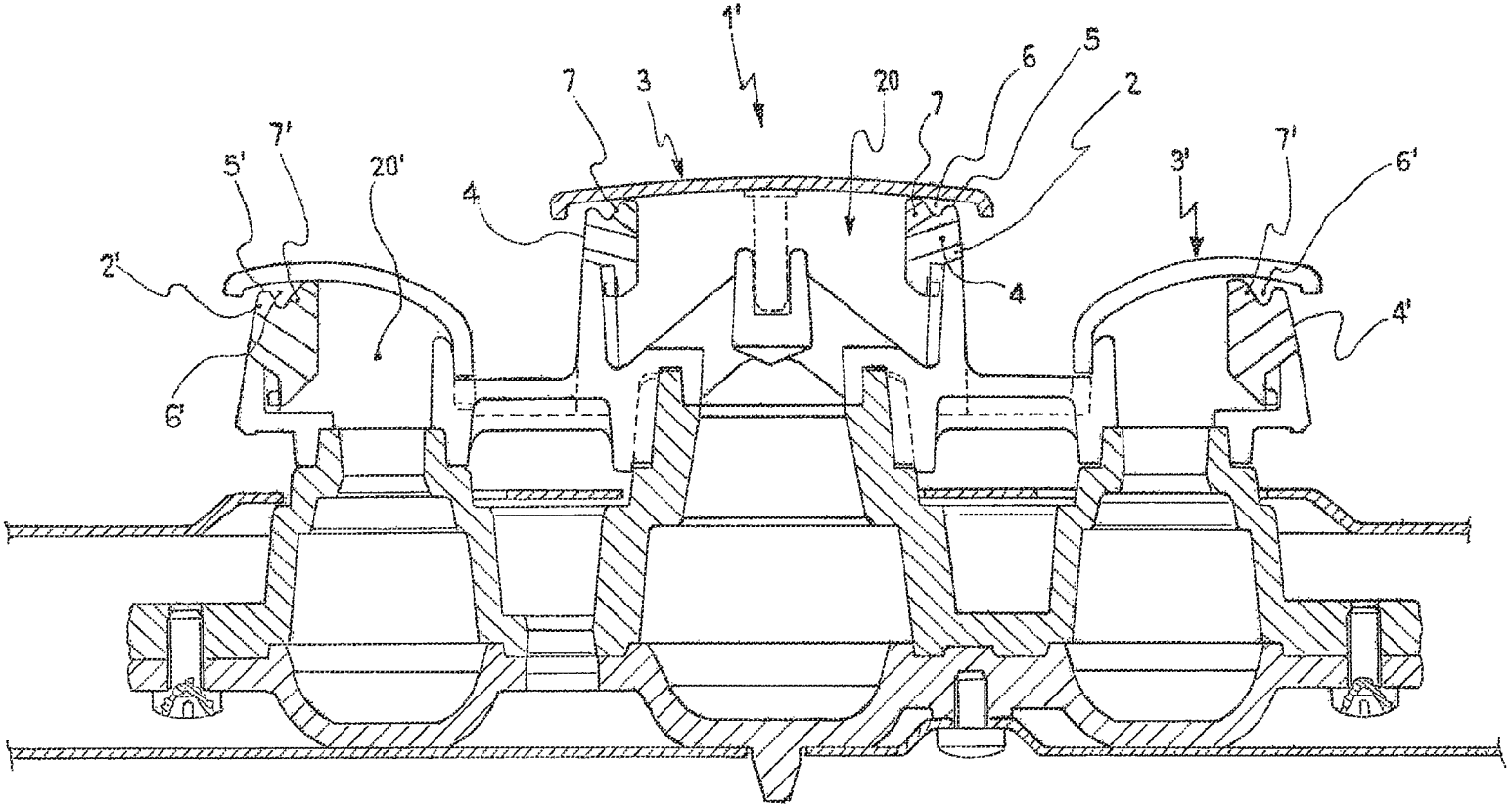
FIG. 4 is a section view of a burner according to the invention provided with several flame spreaders.
Figure 6:
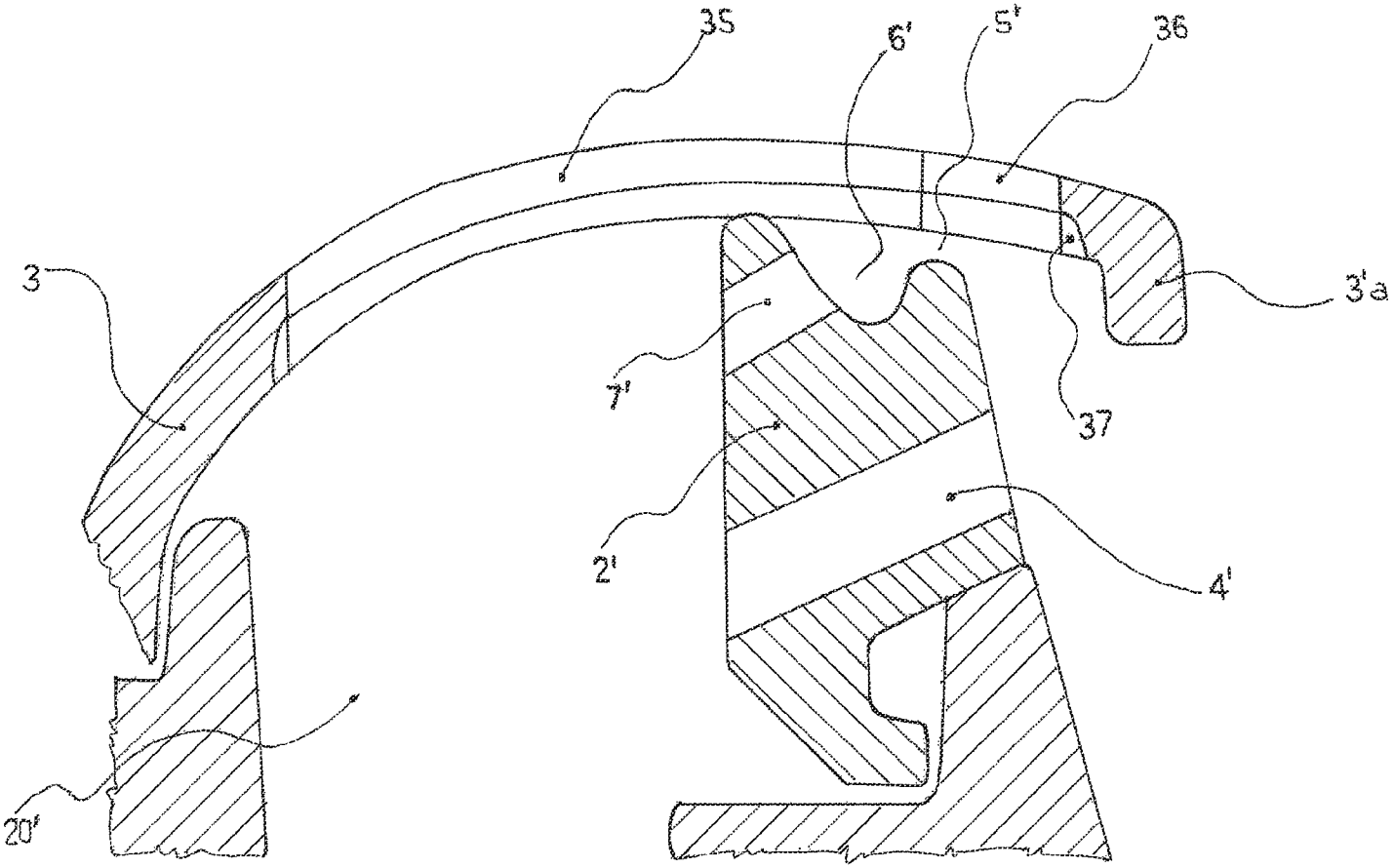
FIG. 6 is a detailed section view of the burner region of FIG. 4 around the highlighted notch in FIG. 5.

The FIGS. 4, 5 and 6 show a different embodiment of the burner 1', according to the present invention, comprising two flame spreaders 2 and 2', reciprocally concentric, one placed in a central position, the other in a peripheral position, defining concentric flame crowns.

Figure 2:
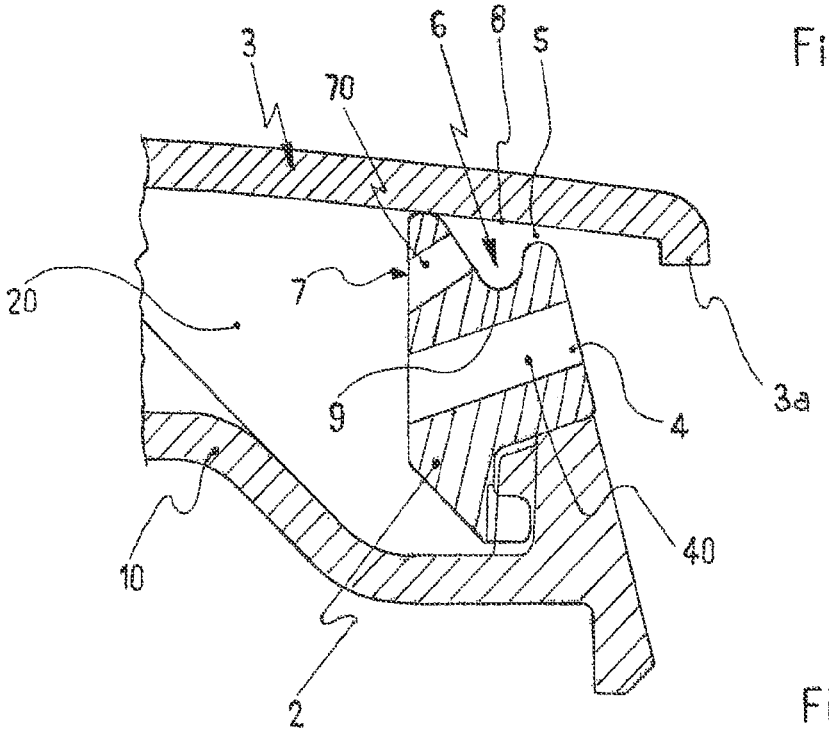
FIG. 2 is a detailed view of the burner of FIG. 1.

Each of such flame spreader 2, 2', similarly to the burner 1 above described, is provided with an outlets 4, 4' of the fuel mixture for the main flames and with an outflow port 5, 5' of the fuel mixture for the pilot flame, as well as a storage chamber 6, 6' for the fuel mixture, placed immediately upstream of the outflow port 5, 5' and immediately downstream of the inlets 7, 7', completely similar to those described in the burner 1 of FIGS. 1-3.

Each flame spreader 2, 2' is further coupled to a corresponding upper lid 3, 3', aiding to define, in addition to a corresponding transit chamber 20, 20' for the fuel mixture, placed upstream of the same flame spreader 2, 2', the corresponding storage chamber 6, 6' and the outflow port 5, 5' for the pilot flame.

Similarly to the burner 1 of FIGS. 1-3, the outflow port 5, 5' and the storage chamber 6, 6' of each flame spreader 2, 2' are extended annularly for the whole outer perimeter of the flame spreader 2, 2' itself.

The burner 1' is likewise shaped such that the central flame spreader 2 is in upper position relative to the peripheral flame spreader 2', so that the outlet 4, or the outflow port 5, of the central flame spreader 2 are placed over the lid 3' of the peripheral flame spreader 2'.

The lid 3' of the peripheral flame spreader 2', as particularly shown in FIGS. 5 and 6, is advantageously provided with a radial through notch 35, extended for almost the whole radial length of the lid 3', sitting on the flame spreader 2' itself.

That is, such a notch 35 is extended from the transit chamber 20' defined by the flame spreader 2', to beyond the exit section of the outflow port 5' for the pilot flame.

The notch 35 peaks in a circular hole 36, placed immediately upstream of the beneath storage chamber 6'.

According to a preferred aspect of the present invention, moreover, such a notch 35, and the corresponding circular hole 36, are realized in a lowered region 37 of the same lid 3', that is in a region with a reduced thickness, defining, with the beneath upper surface of the flame spreader 2', a radial passing duct for the fuel mixture.

Such a lowered region 37 allows the passage of proper fuel mixture amount outwardly, causing the practically evenly distribution of the fuel mixture for the whole extension of the radial notch 35, as well fluidically communicating the storage chamber 6' with such a radial notch 35.

It has to be noticed that, alternatively to realizing the notch 35 at a lowered region 37 of the lid 3', the radial notch 35 can be realized in every region—that is not lowered—of the same lid 3' and, with the scope of allowing the optimal passage of the fuel mixture from the storage chamber 6' to the radial notch 35, as well as an even distribution of the mixture along the whole extension of the latter, a recess could be realized, radial too, over the upper surface of the flame spreader 2', such that such a recess, once coupled to the corresponding lid 3' at the notch 35, would act as a duct for transferring and dispensing the fuel mixture for the whole length of the notch 35 itself.

The notch 35 scope is to allow the pilot flame ignition of the peripheral flame spreader 2', thanks to the pilot or main flames of the central flame spreader 2, thereby rendering needless the presence of two ignition spark plugs.

Indeed, once the gas-primary air fuel mixture exiting from the central flame spreader 2 is ignited, by an apposite ignition spark plug acting at the areola of the outflow port 5 for the pilot flame of the central flame spreader 2 itself, the flames produced by the latter lick the notch 35 from which a determined fuel mixture amount is exiting that, in its turn, will go up in flames and propagate the flame to the circular hole 36. From this latter hole 36, the flame penetrates under the lid 3' and ignites the fuel mixture exiting from the outflow port 5' of the pilot flame of the peripheral flame spreader 2', that, in its turn, will ignite the mixture exiting from the outlets 4' of the main flames.

In the burner 1', it will be then sufficient providing the presence of only one ignition spark plug, placed at the outflow port 5 of the pilot flame of the central flame spreader 2, to completely ignite the whole burner 1'.

It has to be noticed that, even if a burner 1' has been described wherein the radial notch 35 of the lid 3' of the peripheral flame spreader 2' allows the flame propagation from the central flame spreader 2 to the latter, a burner can be realized with a concentric flame spreaders, wherein the radial notch 35 may allow the flame propagation from the peripheral flame spreader 2' to the central flame spreader 2. Alternatively, in embodiments herein not illustrated, more radial notches may be provided, or it could be provided that the only peripheral flame spreader, which lid presents one or more radial through notches, is provided with the storage chamber situated immediately upstream of the afore said outflow port for a pilot flame.

The invention claimed is:

1. Burner for gas cookers, said burner comprising:

at least one flame spreader and at least one corresponding lid adapted to define at least partially a transit chamber for a gas-primary air fuel mixture, said at least one flame spreader including, (i) at least a plurality of radial outlets obtained by through holes passing through the flame spreader and in fluidic communication with said transit chamber to feed a plurality of main flames with said fuel mixture, (ii) in combination with said at least one corresponding lid, at least one outflow port disposed above said plurality of radial outlets; to feed at least one pilot flame with said fuel mixture, said at least one outflow port being so shaped as to establish said at least one pilot flame in the direction towards said at least one plurality of radial outlets, and (iii) one or more inlets disposed above said plurality of radial outlets and in fluidic communication with said transit chamber, wherein said at least one flame spreader and at least one corresponding lid define at least one storage chamber for feeding said fuel mixture to said at least one pilot flame, said storage chamber being disposed intermediate of and in fluid communication with said at least one outflow port and said one or more inlets, said storage chamber being fed by said one or more inlets in fluidic communication with said transit chamber for the fuel mixture and said at least one storage chamber being so shaped as to allow a fuel mixture pressure drop sufficient to allow the storage of the fuel mixture in said storage chamber and the delivering of said fuel mixture with a substantially constant pressure at said at least one outflow port said storage chamber being disposed above the through holes passing through the flame spreader, wherein said at least one storage chamber and said at least one outflow port are defined by at least a portion of the lower peripheral surface of said at least one lid and by at least a portion of the an upper peripheral surface of said at least one flame spreader.

2. Burner according to claim 1, wherein said at least one inlet is obtained, at least partially, in said at least one flame spreader.

3. Burner according to claim 1, wherein the area of a passing section (A) of said one or more inlets is comprised from 20 to 50 $mm^2$.

4. Burner according to claim 1, wherein the area of a passing section (B) of said at least one outflow port for the pilot flame is comprised from 65 to 250 $mm^2$.

5. Burner according to claim 1, wherein the volume of said at least one storage chamber is higher than, or equal to, 350 $mm^3$.

6. Burner according to claim 1, wherein the ratio between the section area (B) of said at least one outflow port and the section area (A) of said one or more inlets is comprised from 2.9 to 5.8.

7. Burner according to claim 1, wherein a peripheral end of said lid is shaped to direct said at least one pilot flame towards said at least one plurality of radial outlets.

8. Burner according to claim 1, wherein said at least one inlet for said at least one storage chamber is defined by at least a portion of a lower peripheral surface of said at least one lid and by at least a portion of an upper peripheral surface of said at least one flame spreader.

9. Burner according to claim 1, wherein said at least one storage chamber and said at least one outflow port have an annular shape and extend for at least part of a perimeter portion of said at least one flame spreader.

10. Burner comprising:

two or more flame spreaders, reciprocally concentric, coupled to corresponding lids to define at least two corresponding transit chambers for a fuel mixture, said two or more flame spreaders including, (i) at least a plurality of radial outlets obtained by through holes passing through the flame spreaders and in fluidic communication with said transit chamber to feed with said fuel mixture a plurality of main flames, (ii) in combination with said corresponding lids, at least one outflow port disposed above said plurality of radial outlets of at least one of said flame spreaders, to feed at least one pilot flame with said fuel mixture, said at least one outflow port being so shaped as to establish said at least one pilot flame in a direction towards said at least one plurality of radial outlets, (iii) one or more inlets disposed above said plurality of radial outlets and in fluidic communication with said transit chamber, wherein said at least one of said flame spreaders and at least one of said corresponding lids define at least one storage chamber for feeding said fuel mixture to said at least one pilot flame, said storage chamber being disposed intermediate of and in fluid communication with said at least one outflow port and said one or more inlets, said storage chamber being fed by one or more inlets in fluidic communication with said transit chamber for the fuel mixture and said at least one storage chamber being so shaped as to allow a fuel mixture pressure drop sufficient to allow the storage of the fuel mixture in said storage chamber and the delivering of said fuel mixture with a substantially constant pressure at said at least one outflow port, and at least said storage chamber being disposed above through holes passing through the flame spreader, wherein said at least one storage chamber and said at least one outflow port are defined by at least a portion of the lower peripheral surface of said at least one lid and by at least a portion of the an upper peripheral surface of said at least one flame spreader.

11. Burner according to claim 10, wherein said at least one of said flame spreaders is centrally placed, said outlets of said at least one of said flame spreaders being placed in a position substantially higher than the lid of at least one of said flame spreaders placed in a peripheral position.

12. Burner according to claim 11, wherein the lid of said at least one flame burner placed in a peripheral position is provided with at least one through radial notch.

13. Burner according to claim 12, wherein said at least one through radial notch extends from the corresponding transit chamber of the flame spreader beyond an exit section of said at least one outflow port of the pilot flame.

14. Burner according to claim 12, wherein at least one through radial notch is realized in a region with a reduced thickness of said lid.

15. Burner according to claim 2, wherein said at least one inlet is obtained by through openings passing through said at least one flame spreader and inclined towards the lid.

16. Burner according to claim 4, wherein the area of the passing section (B) of said at least one outflow port for the pilot flame is calculated at a point locus where the lid and the flame crown have the lower distance.

17. Burner according to claim 10, wherein said at least one inlet for said at least one storage chamber is defined by at least a portion of a lower peripheral surface of said at least one lid and by at least a portion of an upper peripheral surface of said at least one flame spreader.

* * * * *